United States Patent [19]

Heinonen

[11] Patent Number: 5,044,602

[45] Date of Patent: Sep. 3, 1991

[54] BLOWOUT PREVENTER

[75] Inventor: Robert L. Heinonen, Dallas, Tex.

[73] Assignee: Double-E, Inc., Dallas, Tex.

[21] Appl. No.: 558,793

[22] Filed: Jul. 27, 1990

[51] Int. Cl.[5] ..... E21B 33/02

[52] U.S. Cl. ..... 251/1.1; 277/26; 166/84

[58] Field of Search ..... 251/1.1; 277/26, 188 A; 166/84

[56] References Cited

U.S. PATENT DOCUMENTS

| | | | |
|---|---|---|---|
| 4,354,304 | 10/1982 | Dixon | 277/26 X |
| 4,515,213 | 5/1985 | Meyer et al. | 277/26 X |
| 4,522,368 | 6/1985 | Sable | 166/84 X |

*Primary Examiner*—John C. Fox

*Attorney, Agent, or Firm*—Johnson & Gibbs

[57] ABSTRACT

A blowout preventer for use on walls and especially adapted to use on a pumping well during a steam flood operation including an upper housing having oppositely disposed rams for extension and retraction between the sealing and non-sealing with a longitudinal member through the blowout preventer into a well, such a polished rod of a pump, a lower housing connected with the upper housing, and a heat responsive seal assembly in the lower housing for sealing with the polished rod during steam flooding, the heat responsive seal assembly including an elastomer seal plug designed to swell to form a seal with the polished rod during steam flooding and including means to compress the seal plug after steam flooding to return the plug to an original non-sealing volume and size below the steam flooding temperature.

21 Claims, 3 Drawing Sheets

BLOWOUT PREVENTER

FIELD OF THE INVENTION

This invention relates to well tools and more particularly relates to a device for installation on a tubing head at the top a well to confine pressure in the well and more commonly known the industry as a blowout preventer. The invention further relates to seal assemblies for use in a blowout preventer. Still, more particularly, this invention is especially adapted to a blowout preventer used on steam injection wells which are to be pumped. The blowout preventer of the invention is constructed to provide a seal at the upper end of a well around a polished rod extending from the wellhead to a pump in the well to raise well fluids to the surface.

HISTORY OF THE PRIOR ART

It is a common, well known practice in the oil and gas industry to use wellhead devices which confine pressure in a well around a member such a polished rod or wireline extending into the well during emergency conditions and when it is necessary to shut the well in for servicing the well. A very wide variety of blowout preventers has been available for such purposes. Typical examples of prior art blowout preventers are shown in the following U.S. Pat. Nos. 2,194,255 and 2,194,256, issued to H. Allen on Mar. 19, 1940; 3,399,901, issued to M. L. Crow, et al. on Sep. 3, 1968, and 3,416,767, issued to L. Blagg on Dec. 17, 1968. Another blowout preventer having a number of features of the present invention is disclosed and claimed in U.S. Pat. No. 4,844,406. These prior art devices and others known to the Applicant are not designed to withstand the extreme operating conditions encountered in steam injection wells where temperatures from saturated injected steam may reach the vicinity of at least 550° F. Steam injection wells are employed in a secondary recovery technique in which steam is injected at a wellhead and forced down a well into an earth formation to heat up the fluids such as oil in the formation to a temperature at which the fluids will more readily flow into the well and can be pumped to the surface. The elevated temperatures cause a number of problems in seal assembly designs and materials which have been used in blowout preventers. Particular problems are found in trying to use the same seal materials at elevated temperatures and then at lower temperatures when the seals cool off. Rubber being used in blowout preventer rams under such operating conditions may harden to the point of not being usable. The hardening, of course, occurs when the ram seals cool down after use at such elevated temperatures. Another defect which is found is that the ram seal material at the elevated temperatures get so soft that it is in a fluid state in which it flows out of position and will not hold a seal. One attempted solution is the use of asbestos in rams of a blowout preventer. Also, certain plastic materials have been tried and found effective at elevated temperatures, but in the low temperature operating ranges they become so hard and stiff that they will not form a good seal. Thus, what is needed is a blowout preventer which will effectively seal at elevated steam flood temperatures as well as lower temperatures which occur when steam flooding is not being used.

SUMMARY OF THE INVENTION

It is an object of the invention to provide a new and improved blowout preventer.

It is another object of the invention to provide a new and improved blowout preventer which will effectively seal over a range of temperatures up to a maximum when steam flooding is being used in a well.

It is another object of the invention to provide a blowout preventer in which is capable of sealing at elevated steam flooding temperatures of at least 550° F. or higher.

It is another object of the invention to provide a blowout preventer which includes separate seal assemblies for sealing at elevated temperatures and at lower normal temperatures, respectively.

It is another object of the invention to provide a blowout preventer which has an upper conventional ram-type seal assembly for lower temperatures and a lower seal assembly including a cone shaped packing plug formed of a composition one component of which is an elastomer for sealing at elevated steam flood temperatures.

It is another object of the invention to provide a blowout preventer useful for sealing around polished rods in well pumping systems, wirelines, and tubing extending into and through a wellhead.

It is another object of the invention to provide a blowout preventer having a seal assembly for elevated temperatures including a seal plug which does not extrude from the device during sealing at elevated temperatures.

It is another object of the invention to provide a seal assembly for operation in a blowout preventer at elevated temperatures which includes a seal plug which expands at elevated temperatures to ensure sealing at such temperatures and is returned to its normal shape at reduced temperatures.

It is a further object of the invention to provide a blowout preventer for use in steam flood wells which includes a lower seal assembly for sealing at elevated temperatures effected by steam flood operations and an upper seal assembly comprising conventional rams for sealing at lower normal temperatures.

In accordance with the invention, there is provided a blowout preventer especially adapted for use on steam flood wells having upper opposed ram-type seal assemblies for sealing around a sucker rod or the like at normal temperatures and a lower seal assembly including a spring loaded cone shaped elastomer packing plug which expands to seal around a sucker rod or the like at elevated temperatures and is returnable to its original geometry by spring action as the packing plug cools to lower normal temperatures.

BRIEF DESCRIPTION OF THE DRAWINGS

The foregoing objects and advantages and a preferred embodiment of the invention will be better understood from the following detailed description taken in conjunction with the accompanying drawings wherein.

DETAILED DESCRIPTION OF THE PREFERRED EMBODIMENT

Figure 1:
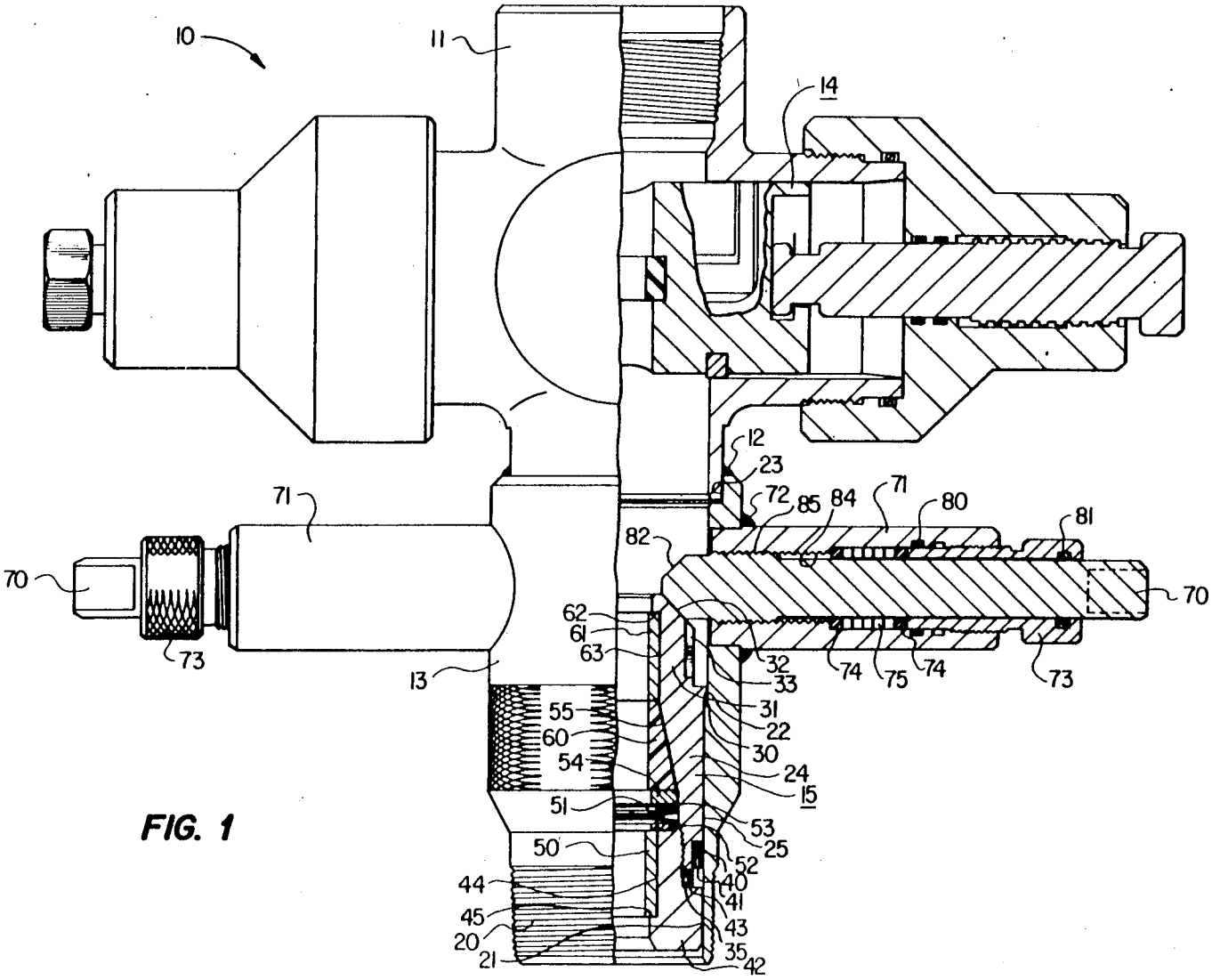
FIG. 1 is a side view partially in section and elevation of a blowout preventer embodying the features of the invention.

Referring to FIG. 1, a blowout preventer 10 embodying the features of the invention includes a ram housing 11 secured as by welding at 12 on a tubular base 13. A pair of oppositely disposed upper seal assemblies comprising conventional rams 14, such as a blowout preventer ram part No. 12R17 available from Double-E Ino., Dallas, Tex., are mounted in the housing 11 for sealing at normal temperature with a sucker rod, not shown, extending through the blowout preventer 10. In accordance with the invention, a lower, heat responsive, seal assembly 15 is mounted in the base 13 for sealing with the sucker rod at substantially elevated temperatures, such as when steam is being injected into a well on which the blowout preventer is mounted. The ram seal assemblies 14 provide the normal blowout preventer primary seal functions, when necessary, and provide secondary seal functions during steam flooding of a well on which the blowout preventer is mounted. The lower seal assembly 15 serves as a primary seal during steam flooding and effectively isolates the ram assemblies from the more elevated temperatures experienced during steam flooding. In accordance with the unique features of the invention, the seal assembly 15 effectively seals at elevated temperatures without extrusions and returns to its original geometry at normal temperatures without hardening to a degree that the seal is rendered useless contrary to the case of prior art rubber seals, particularly as used in blowout preventer rams.

Referring to FIG. 1, the base 13 is a tubular member threaded along a lower end portion at 20 for connection with the surface end of well casing, not shown. The base has a bore 21 which is enlarged along an upper end portion providing an internal annular stop shoulder 22 for supporting the seal assembly 15 in operating position in the base. An upper end portion of the base is counterbored at 23 to receive the lower end of the housing 11 which as previously indicated, is welded to the base 13 by an annular weld 12 between the base and the housing.

Figure 4:
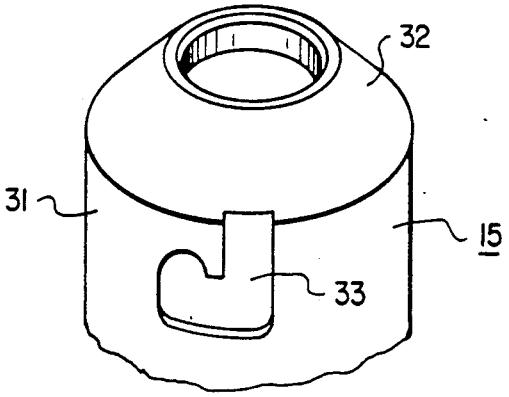
FIG. 4 is a fragmentary top perspective view of the housing of FIGS. 2 and 3.
Figure 3:
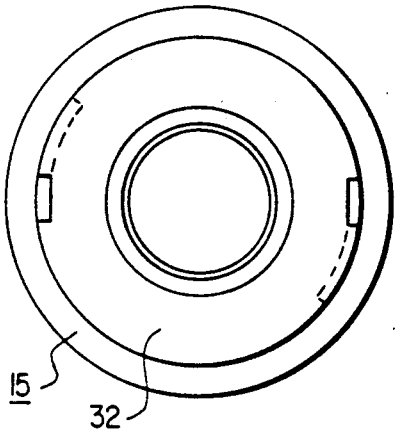
FIG. 3 is a top view of the housing of FIG. 2.
Figure 2:
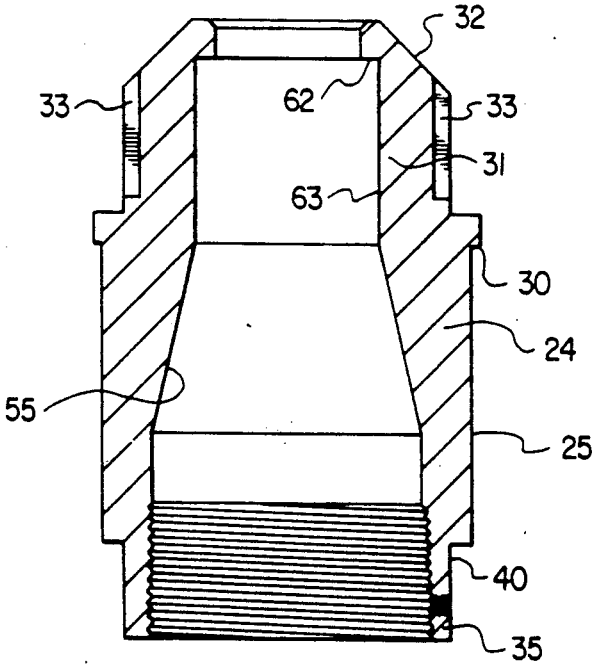
FIG. 2 is a longitudinal view in section of the seal housing of the blowout preventer of FIG. 1.

As illustrated in FIG. 1, the lower seal assembly 15 includes a tubular seal housing 24 which has a cylindrical outer surface 25 sized to fit in the base bore 21. The housing 24 has an external annular stop shoulder 30 which engages the shoulder 22 in the base supporting the seal assembly housing in the base. The housing 24 is reduced in outside diameter along an upper end portion 31 which is provide with an upwardly and inwardly tapered end surface 32. The reduced housing portion 31 has a pair of oppositely disposed upwardly opening J-slots 33, shown in perspective in FIG. 4. A lower end portion 35 of the seal assembly housing 24 is reduced in external diameter providing an outwardly and downwardly opening seal recess 40 for a U-cup seal 41 to seal between the housing 24 and the bore surface 21 of the base 13. The configuration of the U-cup seal 41 includes a downwardly opening recess so that a pressure differential across the seal with the higher pressure below the seal tends to spread the seal to increase the sealing capability of the seal between the seal housing 24 and the base 13. A seal and bushing retainer nut 42 is threaded into the lower end of the seal housing 24. A set screw 43 in the seal housing 24 locks the nut 42 with the seal housing. The outer diameter of the nut 42 fits in the seal housing bore 21 so that the nut 42 retains the U-cup seal 41 in place in the recess 40. The nut 42 has a two-step bore 44 providing a stop shoulder 45 for supporting a tubular bushing 50 in the nut 42. The bushing 50 is formed of bronze or a similar, somewhat soft, metal and has a bore slightly larger than a sucker rod, not shown, extending through the blowout preventer so that the sucker rod may be freely reciprocated during pumping. The upper end edge 51 of the nut 42 supports an annular steel retainer 52 which engages the upper end edge of the bushing 50 holding the bushing in place in the nut 41 against the stop shoulder 45 of the nut. A spring 53 is supported on the bushing retainer 52. The spring 53 may be a coil spring, though, preferably, it comprises a stack of Bellville washers, such as four washers, which are substantially more compact than a coil spring. As is well known, Bellville washers are conical shaped washers which may be stacked to provide a very compact assembly which acts like a very strong spring. An annular plate or washer 54 made of a metal such as bronze is mounted on the spring 53 so that the Bellville washers forming the spring are captured between the bushing retainer 52 and the annular thrust plate 54. The retainer 52, the spring 53, and the plate 54 are all housed in a uniform diameter portion of the bore of the tubular seal housing 24. The bore through the plate 54 is somewhat larger than the bore through the bushing 50 to provide ample clearance between the plate and a sucker rod, not shown, through the blowout preventer so that the plate may freely move relative to the sucker rod as explained in more detail below. A central portion 55 of the bore through the seal housing 24 is tapered upwardly and inwardly defining a conical surface along the bore of the housing. In accordance with the invention, an annular packing plug 60 having an outer conical surface is mounted in the seal housing 24 along the conical bore portion 55 of the seal housing. The conical packing plug is formed of an elastomer material the preferred composition Of which is 75 percent Teflon and 25 percent graphite, such a material being available from the Chicago Gasket Company under the trademark Ebolon. The packing plug 60 is particularly suitable for service in the blowout preventer of the invention because the material forming the seal expands at the elevated temperatures of the blowout preventer during steam flooding to effectively seal around a sucker rod in the housing 24 and the material does not react to the temperature by unduly hardening. After the desired expansion for effective sealing, the packing plug is readily returned to its original geometry by the force Of the spring 53 and may be repeatedly exposed to the elevated temperatures without deterioration which affects the functioning of the packing plug. A tubular bushing 61 is mounted in the bore of the seal housing 24 above the packing plug 60 below a downwardly facing internal annular stop shoulder 62 in the housing 24. The bushing 61 fits in a uniform diameter portion 63 of the bore of the housing above the conical bore portion 55 of the housing. Thus, the packing plug 60 is captured in the conical bore portion of the housing between the plate 54 at the lower end of the packing plug and the tubular bushing 61 at the upper end of the packing plug. There is only a moderate amount of compression in the spring 53 so that the packing plug 60 is essentially under no load during normal operating temperatures when a well is not being steam flooded.

The particular conical geometry of the packing plug 60 is provided to minimize the longitudinal expansion of the packing plug at elevated temperatures. "Longitudinal" in terms of the packing plug means along the length of the plug along the axis through the bore, the vertical axis as seen in FIG. The use of the conical shape provides a larger volume, and thus, a larger area over the bottom end of the packing plug so that as the volume of the plug increases under elevated temperatures there is less increase in length of the plug as opposed to the use of a straight cylinder shaped plug. The packing plug at the elevated temperatures expands sufficiently to provide the desired sealing but is not rendered flowable. The plug material is transformed into an intermediate state in which it expands, does not readily flow, but does not retain a memory so that it would not return to its original geometry without the affect of the spring 53, as described in more detail below.

The seal assembly 15 is held in the bore of the blowout preventer base 13 by a pair of oppositely disposed hold-down locking screws 70 which thread into oppositely extending tubular packing boxes 71 secured on opposite sides of the base 13 as by welding at 72. The packing boxes 71 are mounted on the base along a common longitudinal axis coincident with the axis of each the packing boxes and extending perpendicular to the vertical axis, not shown, of the base 13. Each of the locking screws 70 fits through a tubular packing nut 73 threaded into the box 7 around the screw, as best seen in the right hand sectioned portion of FIG. A packing assembly comprising adaptor rings 74 and packing rings 75 is mounted in each of the packing boxes 71 around the screw. 70 to seal between the bore of the packing box and the screw surface. An O-ring seal 80 in the packing box 71 seals between the packing box and the nut 73. Another O-ring seal 81 in the nut 73 around the screw 70 seals between the nut and the screw. The inward end of each the screws 70 has a tapered conical surface 82 engageable with the conical end surface 32 of the seal housing 24. The end surfaces 82 of the two oppositely disposed screws 70 engage opposite sides of the end surface 32 of the housing 24 holding the seal assembly 15 in operating position within the bore of the base 13 against the stop shoulder 22. An inward end portion of the bore of each of the packing boxes 71 is internally threaded and an inward portion of each of the locking screws 70 is externally threaded at 85 with threads corresponding with and engaging the internal threads 84 of the packing boxes so that the screws 70 may be screwed inwardly to engage the end surface 32 of the seal assembly housing 24, and the screws may be unscrewed outwardly for release and removal of the seal assembly 15.

Figure 5:
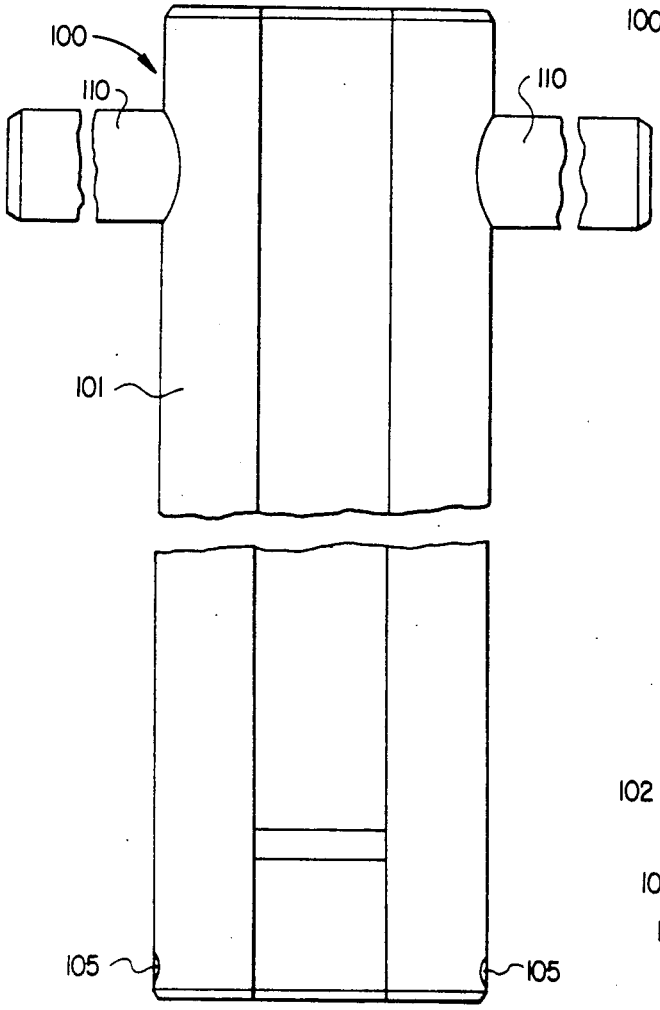
FIG. 5 is a side view in elevation of an extraction tool for removing the seal housing of FIGS. 2–4 from the blowout preventer body base.
Figure 6:
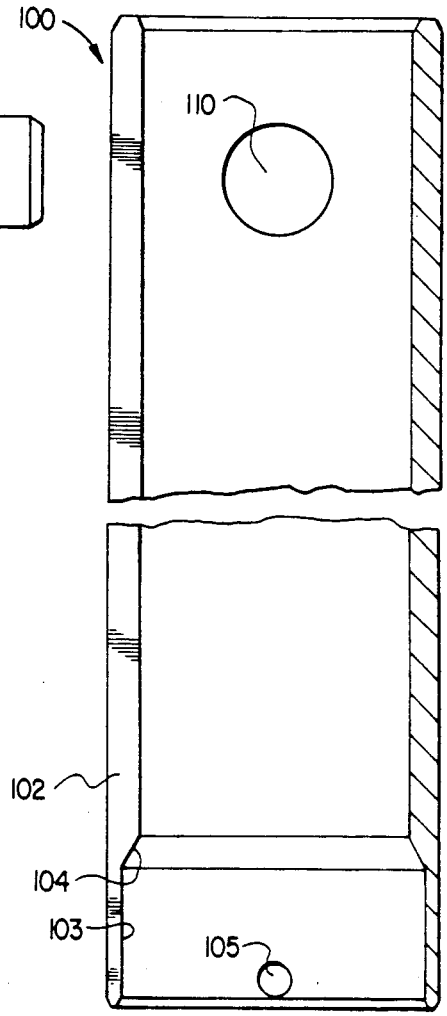
FIG. 6 is a longitudinal view in section and elevation of the extractor of FIG. 5 taken along a plane perpendicular to the view of FIG. 5.
Figure 7:
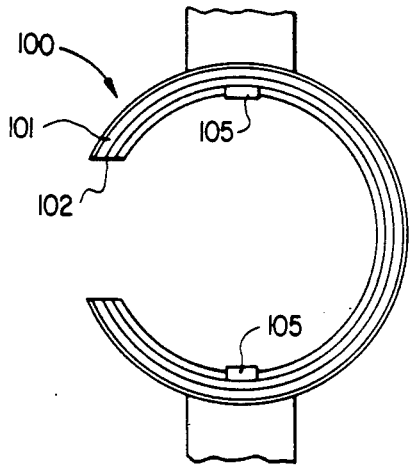
FIG. 7 is a bottom view of the extractor of FIGS. 5 and 6.

FIGS. 5–7 illustrate an extraction tool 100 is used to remove and install the seal assembly 15 for replacement and servicing. The tool 100 has a C-shaped body comprising a segment of a cylinder having a longitudinal slot 102 running the full length of the body. The bore of the lower end portion of the body at 103 is enlarged terminating at a tapered shoulder 104. Oppositely disposed inwardly extending lugs 105 are secured at the lower end of the enlarged lower end portion of the body bore. Identical handles 110 are secured on opposite sides of and near the upper end of the body for holding and operating the tool. As described in further detail hereinafter, the slot 102 permits the extraction tool to fit around a sucker rod extending through the blowout preventer 10 for extracting the seal assembly 15 while the sucker rod is in position through the blowout preventer. The extraction tool body 101 is sized to fit in the vertical bore of the blowout preventer body with the enlarged body bore portion 103 permitting the lower end portion of the extraction tool to telescope downwardly over the upper end portion of the seal assembly housing 24. The lugs 105 fit in the J-slots 33 on housing 24 with the tapered surface 104 in the extraction tool body being engageable with the seal assembly housing upper end surface 32. The extraction tool 100 is used to engage the packing assembly 15 and remove the assembly through the upper end of the blowout preventer 10. The tool may also be used to install the packing assembly. It will be apparent that the rams 14 and the screws 70 are retracted from the bore through the blowout preventer body to permit the extraction tool 100 to be used.

The blowout preventer 10, serving the dual functions of a conventional blowout preventer and providing the extra added protection required in steam flood wells, is installed on the upper end of a well casing for sealing around a polished rod extending from a pump operator above the wellhead through the wellhead and blowout preventer to a downhole pump for removing fluids from the well in the relationship illustrated in FIG. 1 of U.S. Pat. No. 4,415,026. A stuffing box, not shown, normally is included in the wellhead assembly above the blowout preventer of the invention for sealing around the polished rod during the pumping operation. The blowout preventer of the invention is included in a wellhead assembly on a well where production may be improved by the use of steam flooding. In accordance with standard procedure, a steam line, not shown, is connected into the production tubing below the blowout preventer of the invention. After the well is completed for pumping, and if there is sufficient fluids in the well at this point to pump, then normal pumping is carried out. During the normal pumping, the rams 14 are retracted outwardly so that they do not seal around the polished rod. During normal pumping the lower seal assembly 15 will not form an effective seal with the polished rod which is essentially free to reciprocate. Also, of course, the rams 14 are retracted leaving the polished rod free to reciprocate through a seal around the polished rod in the stuffing box, not shown, above the blowout preventer of the invention. Under normal pumping conditions, if an emergency seal is required around the polished rod, the rams 14 of the blowout preventer are run inwardly around the polished rod in the normal manner.

When steam flooding of the well is required to continue or improve well production, the pump is stopped and possibly unseated. The stuffing box above the blowout preventer is normally left in place. The blowout preventer rams are closed around the polished rod. Steam is then pumped into the well through the production tubing, and at the producing zone in the well the steam flows outwardly from the production tubing into the producing formation. Saturated steam at 550° F. may be used for the flooding operation. Normally, the steam flooding may continue for as long as a week. As the well is heated by the steam, the conical packing plug 60 swells. The conical shape of the plug and the bore surface 55 surrounding the plug causes the plug to expand inwardly and downwardly around the polished rod. It has been found that when the temperature at the packing plug reaches approximately 300° .F sufficient swelling has occurred to form an effective seal with the polished rod. As the packing plug is heated, the plug expands approximately 10–14%. The wedging action of the expanding packing plug tightly jams the packing plug between the seal housing 24 and the polished rod through the blowout preventer passing through the bore of the seal plug. As the packing plug expands, the Bellville washers forming the spring 53 are compressed allowing downward axial expansion of the packing plug, in accordance with the unique features of the invention. It will be recognized that the thrust plate or washer 54 at the lower end of the packing plug is pushed downwardly by the expanding packing plug against the top of the Bellville washer spring 53. The use of the spring serves a dual purpose. During the steam flooding the spring permits the expansion of the plug aiding and retaining the conical shape of the plug as the swelling plug acts as a wedge with the polished rod and, very importantly, permitting the expansion without extrusion of the material forming the plug. If the plug were not permitted to expand utilizing the spring action, a portion of the plug material would extrude from the proper position in the seal assembly. During the flood, the packing plug may heat to the temperature of the saturated steam, i.e. 550° F., while the lower seal assembly 15 protects the rams 14 from this high temperature which would damage the rams. It has been found that the temperature drop across the seal assembly is in the range of 200° F. to 250° F. Thus, the rams 14 are never exposed to the damaging high temperature.

In practice, the steam flooding operation may continue for a period of time, such as a week. The steam flow is terminated and the well is allowed to cool down for anywhere from a few days to a week, during which time some of the steam, hot water, and some oil will flow back into the well. When the temperature drops sufficiently, the rams 14 are reopened and the well pump is reseated and pumping of the well is resumed. When the temperature has been dropped sufficiently for pumping to the begin again, the packing plug 60 cools sufficiently to release the grip of the plug on the polished rod. In accordance with the invention, as the packing plug cools, it contracts and, responsive to an expanding force in the spring assembly 53 acting upwardly against the plate 54, pushes the packing plug back to the original conical shape of the plug before the steam flooding. The material forming the packing plug 60 has no memory, and thus, without the action of the expanding spring 53, the plug would not return to the original low temperature shape of the plug. The use of the conical shape of the packing plug not only permits the several functions described, but also allows for some wear due to the reciprocating action of the polished rod through the plug. The relatively long surface along the bore of the plug which engages the polished rod minimizes the effect of the wear. Further, the conical geometry of the plug with the larger area across the bottom of the plug provides more volume for expansion, and thus, permits the plug to expand without changing in length as much as if the plug was in the shape of a straight cylinder.

Experience has shown that a formation may retain sufficient heat after steam flooding for improved production to last as long as six months.

When it becomes necessary to service the blowout preventer of the invention, such as by removal of the seal assembly 15, the wellhead components above the blowout preventer will have to be removed to the extent to permit access to the upper end of the vertical bore thorough the blowout preventer. The rams 14 and the hold-down screws 70 are retracted sufficiently to clear the bore so that the seal assembly including the seal housing 24 may be pulled upwardly and extracted from the body of the blowout preventer. The split extraction tool 100 is inserted downwardly in the bore of the body Of the blowout preventer. The vertical slot 102 in the extraction tool permits use of the extraction tool without removing the polished rod from the well. The lower enlarged end portion 103 of the extraction tool is inserted downwardly over the reduced upper end 31 of the seal housing 24. The extraction tool is rotated and pressed downwardly to guide the internal lugs 105 into the J-slots 33. After the lugs 105 enter the J-slots, the tool is pressed farther downwardly and rotated clockwise as viewed from above the tool, to guide the lugs 105 into the J-slots to positions as will be evident from FIG. 4 which will couple the lugs into the J-slots so that an upward pull on the handles 110 of the extraction tool will exert an upward force on the housing 24 so that the entire seal assembly 15 is extracted upwardly from the body of the blowout preventer. After the necessary repair and/or replacement of parts of the seal assembly 15, the seal assembly may be reinserted downwardly into the operating position shown in FIG. 1 using the extraction tool with the lugs 105 in the J-slots 33. After the packing assembly in reinstalled in the position shown in FIG. 1, the hold down screws 70 are run back inwardly to positions shown in FIG. 1 so that the tapered end edge 82 of each of the screws engages the upper tapered end surface 32 of the body 24 of the packing assembly. The screws 70 effectively hold the packing assembly in place against any upward drag from the polished rod and steam pressure during the flooding operation.

It will now be seen that a new and improved blowout preventer has been described and illustrated for use on the pumping wells where steam flooding is employed to enhance well production. The blowout preventer utilizes conventional upper rams for sealing with the polished rod at lower well temperatures and a heat responsive lower seal assembly especially adapted for high temperature operations, such as in steam flooding. The lower seal assembly deforms responsive to heat generally above about 300° F. protecting the upper rams from the higher temperatures, and thereafter, when the temperature returns below 300° F., the seal assembly contracts returning to its normal shape and releasing the seal with the polished rod.

What is claimed is:

1. A blowout preventer for use on a well to seal around a well member extending through said blowout prevent into said well comprising:

an upper housing having a bore for said well member;

oppositely disposed ram assemblies secured in said upper housing for extension into intersecting relationship with said bore to seal around said well member and retractable from said bore into non-sealing relationship with said well member;

a lower housing secured with said upper housing and having a bore for said well member aligned along a common axis with and opening into said bore of said upper housing; and a heat responsive seal assembly in said lower housing for sealing with said well member responsive to a well temperature at said seal assembly above a predetermined value.

2. A blowout preventer in accordance with claim 1 where said heat responsive seal assembly includes: a seal plug adapted to swell from a first nonsealing volume and shape to effect a seal with said well member above said predetermined temperature; and means in said lower housing for compressing said heat responsive seal plug to compress said seal plug back to said first volume and shape.

3. A blowout preventer in accordance with claim 2 where said seal plug has a cylindrical bore for said well member and a conical outer surface.

4. A blowout preventer in accordance with claim 3 where said seal plug is an elastomer material.

5. A blowout preventer in accordance with claim 4 where said seal plug comprises Teflon and graphite.

6. A blowout preventer in accordance with claim 5 where said seal plug comprises about 75% Teflon and 25% graphite.

7. A blowout preventer in accordance with claim 3 where said means for compressing said seal plug is a spring.

8. A blowout preventer in accordance with claim 7 where said spring comprises Bellville washers.

9. A blowout preventer in accordance with claim 8 including a thrust plate between said spring and a base end of said seal plug.

10. A blowout preventer in accordance with claim 2 including means in said lower housing extendible into said bore of said housing and engageable with said seal assembly to releaseably lock said seal assembly in place in said housing.

11. A blowout preventer in accordance with claim 10 where said means for locking said seal assembly comprises oppositely disposed locking screws extendible into said bore of said lower housing against said seal assembly to lock said assembly and retractable from said bore to release said assembly.

12. A blowout preventer for a well to seal around a longitudinal well member extending through said preventer into said well comprising:

an upper seal assembly including extendible and retractable rams for sealing around said well member at a temperature below a determined value; and a lower heat responsive seal assembly for sealing around said well member at a temperature above said predetermined value.

13. A blowout preventer in accordance with claim 12 where said lower seal assembly includes an elastomer seal plug adapted to swell from a first non-sealing volume and shape to a second volume and shape in sealing relationship with said well member above said predetermined temperature; and means for compressing said seal plug back to said first non-sealing volume and shape below said predetermined temperature.

14. A blowout preventer in accordance with claim 12 wherein said seal plug is conical in shape.

15. A blowout preventer in accordance with claim 13 wherein said means for compressing said seal plug is a spring.

16. A blowout preventer in accordance with claim 15 wherein said spring is a plurality of Bellville washers.

17. A blowout preventer for a well for sealing around a longitudinal well member extending through said blowout preventer into said well comprising:

an upper seal assembly including a housing having a bore therethrough for said well member and oppositely disposed extendible and retractable rams for extending into said bore to seal around said well member at a temperature below a predetermined value and for retraction from said bore away from said well member to a non-sealing relationship with said well member; and a lower seal assembly including a housing having bore for said well member opening to said bore of said housing of said upper seal assembly, said bores of said housing of said upper seal assembly and said housing of said lower seal assembly being aligned along a common axis, a seal plug housing mounted in said bore of said housing of said lower seal assembly, said seal plug housing having a cylindrical outer surface and an upwardly and inwardly tapered inner surface, a heat responsive seal plug in said seal plug housing, said seal plug having a tapered outer surface engageable with said tapered inner surface of said seal plug housing and a cylindrical bore having a longitudinal axis coincident With the axis through said housings of said upper and lower seal assemblies, a spring assembly in said seal plug housing below said seal plug to permit said seal plug to swell from a first non-sealing volume and shape to a second sealing volume and shape above a temperature of a predetermined value and to return said seal plug from said second sealing volume and shape to said first non-sealing volume and shape below said determined temperature, and hold-down screw means in said housing of said lower seal assembly extendible into said bore of said housing to hold said lower seal assembly in operating position in said housing and retractable from said bore of said housing to release said lower seal assembly from said housing.

18. A blowout preventer in accordance with claim 17 wherein said seal plug housing has a tapered upper end surface engageable by said hold-down screw means for holding said lower seal assembly in operating position in said housing of said lower seal assembly and said seal plug housing has external slot means for engagement by an installation and extraction tool for installing and removing said lower seal assembly from said lower seal assembly housing.

19. A blowout preventer in accordance with claim 18 including a tubular bushing in said seal plug housing above said seal plug; an annular thrust plate in said seal plug housing below said seal plug between said seal plug and said spring; an annular bushing retainer in said seal plug housing between said spring and said second bushing in said housing below said seal plug; and a seal in said lower housing between said lower housing and said seal plug housing.

20. A blowout preventer in accordance with claim 1 where said seal plug comprises an elastomer.

21. A blowout preventer in accordance with claim 20 where said elastomer comprises Teflon and graphite.

* * * * *